US008660287B2

(12) United States Patent
Stephenson

(10) Patent No.: US 8,660,287 B2
(45) Date of Patent: Feb. 25, 2014

(54) SEAMLESS HEADSETS AND RELATED SYSTEMS AND METHODS OF MANUFACTURE

(75) Inventor: Shawn M. Stephenson, Durham, NC (US)

(73) Assignee: HTC Corporation, Taoyuan, Taoyuan County (TW)

( * ) Notice: Subject to any disclaimer, the term of this patent is extended or adjusted under 35 U.S.C. 154(b) by 0 days.

(21) Appl. No.: 13/325,327

(22) Filed: Dec. 14, 2011

(65) Prior Publication Data

US 2013/0077814 A1 Mar. 28, 2013

Related U.S. Application Data

(60) Provisional application No. 61/540,370, filed on Sep. 28, 2011.

(51) Int. Cl.
*H04R 25/00* (2006.01)

(52) U.S. Cl.
USPC ..... 381/370; 381/384

(58) Field of Classification Search
USPC ..... 381/370, 384
See application file for complete search history.

(56) References Cited

U.S. PATENT DOCUMENTS 3,082,292 A 3/1963 Gore
3,260,689 A 7/1966 Kibler et al.
3,540,956 A 11/1970 Arnold et al.
3,594,228 A 7/1971 Mock
3,720,747 A 3/1973 Anderson et al.
4,171,860 A 10/1979 Katz
4,538,024 A 8/1985 Wise et al.
4,620,605 A * 11/1986 Gore et al. ..... 181/135
4,870,688 A * 9/1989 Voroba et al. ..... 381/60
5,304,741 A 4/1994 Proulx
6,498,881 B1 12/2002 Thompson et al.
8,068,633 B2 * 11/2011 Lee et al. ..... 381/384
D660,289 S * 5/2012 Lee et al. ..... D14/223
8,363,876 B2 * 1/2013 Miskiel et al. ..... 381/380
2003/0016924 A1 1/2003 Thompson et al.
2005/0084224 A1 4/2005 Greer et al.
2009/0190786 A1 * 7/2009 Miskiel et al. ..... 381/380
2010/0027831 A1 * 2/2010 Lee et al. ..... 381/384
2010/0316229 A1 * 12/2010 Bibl et al. ..... 381/74
2012/0224737 A1 * 9/2012 Cataldo et al. ..... 381/384

* cited by examiner

*Primary Examiner* — Duc Nguyen
*Assistant Examiner* — Sean H Nguyen
(74) *Attorney, Agent, or Firm* — McClure, Qualey & Rodack, LLP

(57) ABSTRACT

Seamless headsets and related systems and methods of manufacture are provided. In this regard, a representative headset includes: an earpiece assembly having a ribbon cable portion and an earpiece portion; the ribbon cable portion having a body and multiple elongated conductors, the body being formed of electrically insulating material; the earpiece portion extending from a distal end of the body, the earpiece portion being configured as a contiguous extension of the insulating material of the body such that the earpiece assembly exhibits a seamless transition from the ribbon cable portion to the earpiece portion.

4 Claims, 4 Drawing Sheets

SEAMLESS HEADSETS AND RELATED SYSTEMS AND METHODS OF MANUFACTURE

CROSS-REFERENCE TO RELATED APPLICATIONS

This application is a utility application that claims priority to U.S. Provisional Patent Application entitled, "METHOD FOR CREATING A MULTIPLE COLOR RIBBON CABLE FOR AUDIO HEADSETS", having Ser. No. 61/540,370, filed Sep. 28, 2011, which is entirely incorporated herein by reference.

TECHNICAL FIELD

The present disclosure generally relates to audio headsets.

BACKGROUND

Handheld electronic devices, such as smartphones and MP3 players, have become prevalent. Oftentimes, users of such devices employ headsets to increase the level of privacy of these devices.

Typically, a headset is formed of multiple components formed of different materials and possibly different processes, with seams being located where one component and/or material transitions to another. Unfortunately, these seams correspond to material discontinuities that can exhibit mechanical weakness in addition to being cosmetically unappealing.

SUMMARY

Seamless headsets and related systems and methods of manufacture are provided. Briefly described, one embodiment, among others, is a headset comprising: an earpiece assembly having a ribbon cable portion and an earpiece portion; the ribbon cable portion having a body and multiple elongated conductors, the body being formed of electrically insulating material; the earpiece portion extending from a distal end of the body, the earpiece portion being configured as a contiguous extension of the insulating material of the body such that the earpiece assembly exhibits a seamless transition from the ribbon cable portion to the earpiece portion.

Another embodiment is a method for manufacturing a headset comprising: providing conductors arranged in a side-by-side configuration; and forming insulating material about the conductors to form a ribbon cable portion of the insulating material and an earpiece portion, the earpiece portion being configured as a contiguous extension of the insulating material of the ribbon cable portion.

Another embodiment is a system for manufacturing a seamless headset comprising: a conductor feed section operative to provide multiple conductors positioned for coating with insulating material; a forming section, positioned downstream of the conductor feed section, operative to coat the conductors with insulating material to form a multi-cable assembly, the multi-cable assembly comprising multiple sets of the conductors of predefined length embedded within the insulating material such that a first of the sets is oriented in an end-to-end relationship with respect to a second of the sets; and a cutting section, positioned downstream of the forming section, operative to separate the multi-cable assembly into multiple earpiece assemblies such that the each of the earpiece assemblies exhibits a seamless transition from the ribbon cable portion to the earpiece portion.

Other systems, methods, features, and advantages of the present disclosure will be or may become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
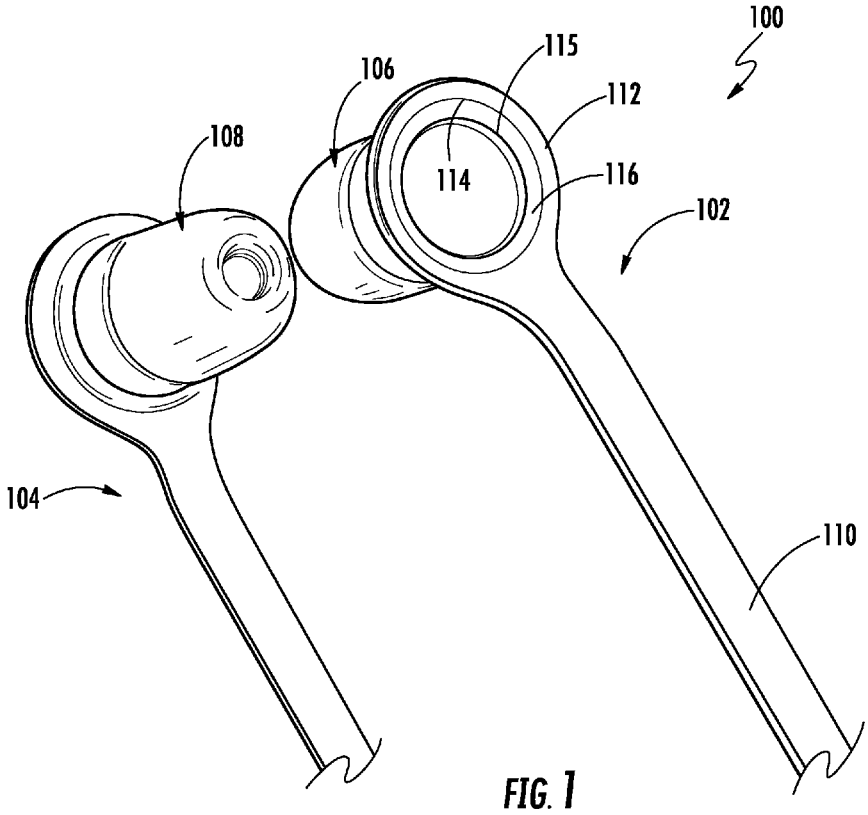
FIG. 1 is a schematic diagram depicting an example embodiment of a headset showing ends of the earpiece assemblies.

Having summarized various aspects of the present disclosure, reference will now be made in detail to that which is illustrated in the drawings. While the disclosure will be described in connection with these drawings, there is no intent to limit the scope of legal protection to the embodiment or embodiments disclosed herein. Rather, the intent is to cover all alternatives, modifications and equivalents included within the spirit and scope of the disclosure as defined by the appended claims.

Seamless headsets and related systems and methods of manufacture are provided. In some embodiments, a headset includes a ribbon cable portion and a seamless transition to an earpiece portion that connects to an earpiece. For providing the seamless transition, insulating material is formed about the conductors of the headset, with the insulating material then being shaped (e.g., cut) to form a connecting location for receiving an earpiece. In some embodiments, multiple sets of conductors are positioned and embedded within insulating material resulting in a continuous sheet that contains conductor sets for producing multiple earpiece assemblies. Thereafter, the sets are separated for downstream assembly.

In this regard, FIG. 1 is a schematic diagram depicting an example embodiment of a headset showing ends of the earpiece assemblies. As shown in FIG. 1, headset 100 includes earpiece assemblies 102 and 104, with each terminating in an earpiece (106, 108). Notably, since each of the earpiece assemblies is similar, only assembly 102 will be described in greater detail.

Specifically, earpiece assembly 102 includes a ribbon cable portion 110 and an earpiece portion 112. The ribbon cable portion incorporates a body and multiple elongated conductors embedded within the body (not shown in FIG. 1). The body is formed of electrically insulating material. By way of example, the insulating material can be PVC, TPE, silicone or rubber, among others. In this embodiment, the body is generally rectangular in cross-section.

Earpiece portion 112 extends from a distal end of the body. In this embodiment, the earpiece portion is configured as a contiguous extension of the insulating material of the body. So configured, the earpiece assembly exhibits a seamless transition from the ribbon cable portion to the earpiece portion.

The earpiece portion 112 includes an aperture 114 that defines an opening through which a grommet 115 extends. Notably, in this embodiment, the grommet incorporates a flange 116 that is used to capture the earpiece portion and attach the earpiece portion to earpiece 106.

Figure 2:
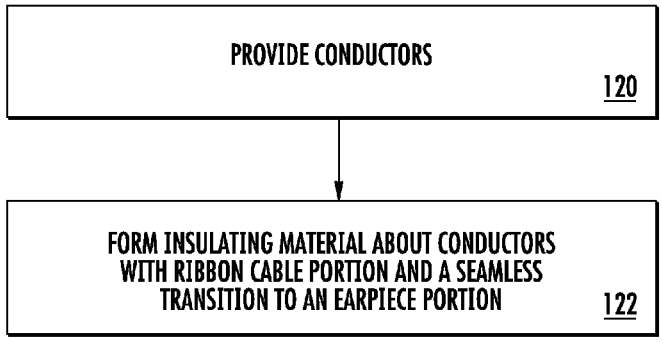
FIG. 2 is a flowchart depicting an example embodiment of a method for manufacturing a headset.

FIG. 2 is a flowchart depicting an example embodiment of a method for manufacturing a headset, such as headset 100 of FIG. 1. As shown in FIG. 2, the method includes providing conductors (block 120). By way of example, the conductors can be elongated conductors arranged in a side-by-side orientation for forming a ribbon cable portion of the headset. Then, as depicted in block 122, insulating material is formed about the conductors to provide a ribbon cable portion with a seamless transition to an earpiece portion. Notably, the earpiece portion is configured for connecting to an earpiece of the headset.

Figure 3:
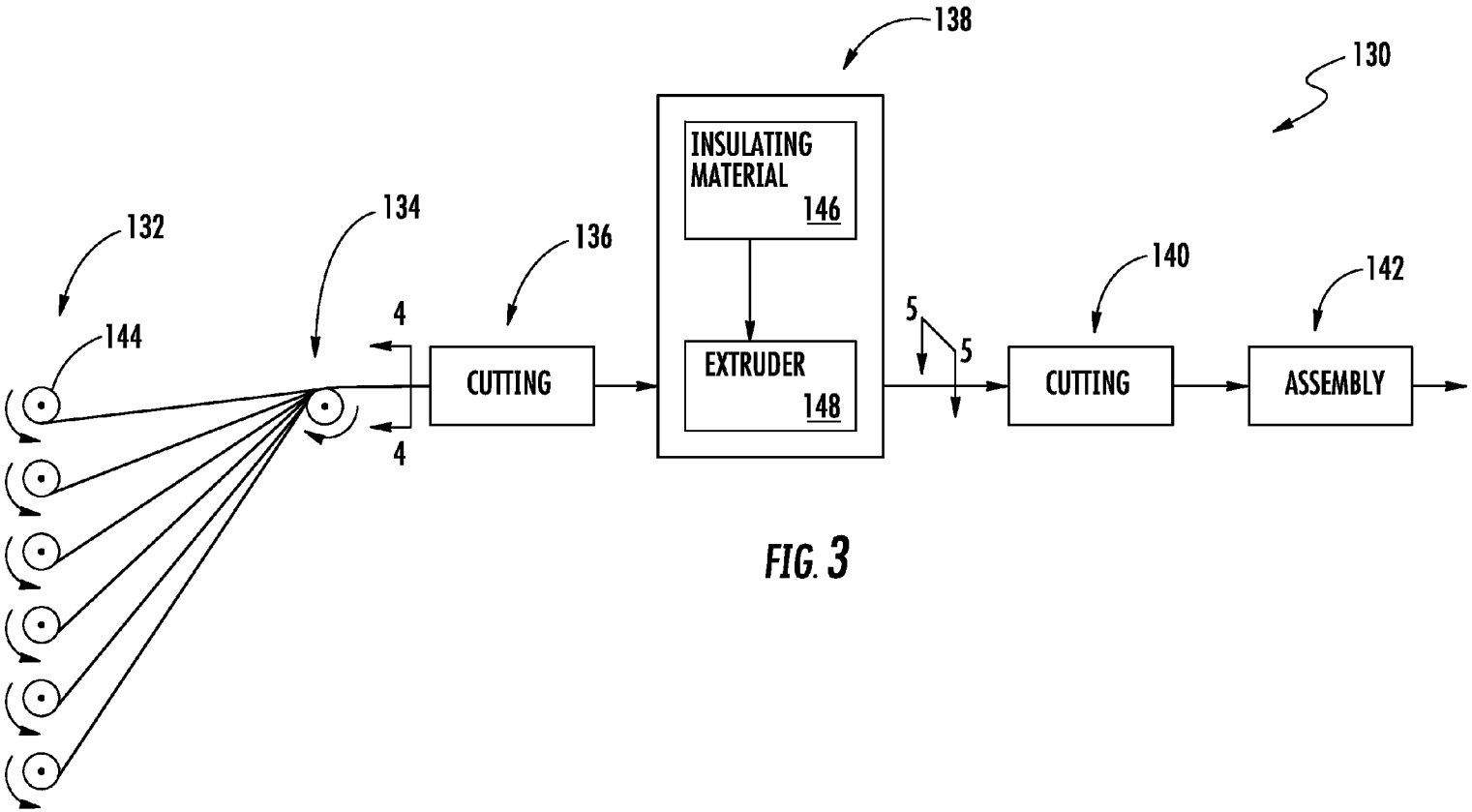
FIG. 3 is a schematic diagram depicting an example embodiment of a system for manufacturing a headset.

FIG. 3 is a schematic diagram depicting an example embodiment of a system for manufacturing a headset, such as according to the method shown in FIG. 2. In FIG. 3, system 130 includes a conductor supply section 132, a conductor feed section 134, a conductor cutting section 136, a forming section 138, a cutting section 140 and an assembly section 142. Conductor supply section 132 incorporates multiple sources of elongated conductors (e.g., copper wire spool 144) that provide conductors for use in forming a multi-cable assembly. In this regard, a multi-cable assembly is a sheet of insulating material in which multiple sets of conductors are embedded for forming earpiece assemblies, namely integrated ribbon cable portions and earpiece portions.

Conductor feed section 134, which is positioned downstream of the conductor supply section, receives the supplies of conductors and orients the conductors for further processing. For instance, the feed section establishes the side-by-side configuration and spacing of the conductors.

Conductor cutting section 136, which is positioned downstream of the conductor feed section, receives the oriented conductors and sizes the conductors to predetermined lengths. Typically, the conductors of a given set of conductors (i.e., the conductors that will be resident in the same earpiece assembly) are sized to exhibit identical lengths.

Forming section 138, which is positioned downstream of the conductor cutting section, coats the conductors with insulating material 146 to form a continuous multi-cable assembly. In this embodiment, an extruder 148 applies the insulating material about the conductors.

Cutting section 140 is positioned downstream of the forming section and is operative to separate the multi-cable assembly into multiple sets of the conductors. In this embodiment, the cutting section includes a cutter that separates the sets of conductors longitudinally while forming the earpiece portions with an aperture that exposes respective distal ends of the conductor sets.

Assembly section 142 is positioned downstream of the cutting section and is operative to facilitate assembly of the earpiece assemblies. For instance, this section can include provisions for attaching grommets and earpieces to the earpiece portions.

Figure 4:
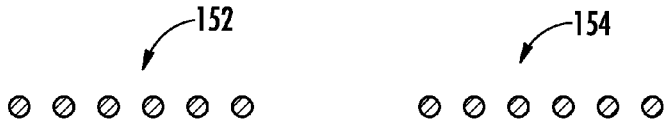
FIG. 4 is a cross-sectional view of the conductors passing through the conductor feed section of the embodiment of FIG. 3, as viewed along line 4-4.

FIG. 4 is a cross-sectional view of the conductors of the embodiment of FIG. 3, as viewed along line 4-4. Note that in FIG. 4, the conductors are oriented in side-by-side relationships and present as two sets of the conductors. In this embodiment, the conductors include a first set of conductors 152 and a second set of conductors 154, with each of the sets incorporating six conductors. Note that in other embodiments, various other numbers and arrangements of conductors can be used. Note also that spacing between the sets of conductors is based, at least in part, on the requirements of the subsequent cutting section that separates the sets.

Figure 5:
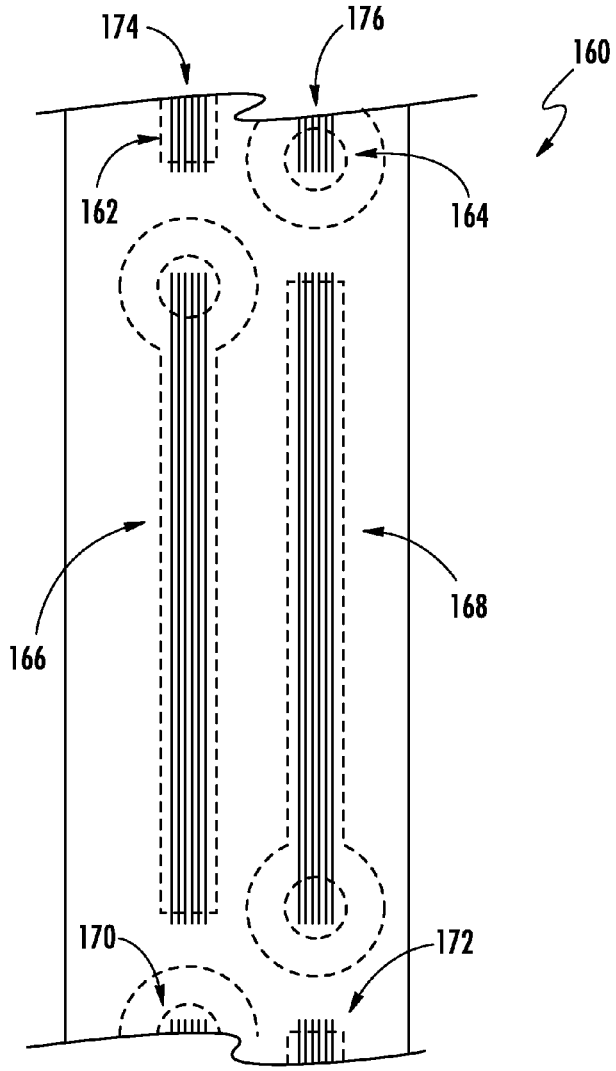
FIG. 5 is a plan view of the embodiment of the multi-cable assembly formed by the embodiment of FIG. 3, as viewed from line 5-5.

FIG. 5 is a plan view of the multi-cable assembly of the embodiment of FIG. 3, taken along line 5-5. As shown in FIG. 5, multi-cable assembly 160 is configured as a continuous sheet of insulating material with embedded sets of conductors. In particular, the assembly is shown in FIG. 5 with 6 sets of conductors (i.e., sets 162, 164, 166, 168, 170 and 172) oriented in two rows (174, 176), with each row including sets of conductors in an end-to-end orientation. In other embodiments, various other numbers and configurations of conductor sets can be provided in a multi-cable assembly.

Note also in FIG. 5 that the dashed lines represent cut lines. In particular, processing in cutting section 140 (FIG. 3) results in each of the sets of conductors being separated from the multi-cable assembly by cuts along the respective cut lines. In some embodiments, the cutting is performed by mechanical cutting implements, whereas in other embodiments various other techniques can be used, such as laser cutting.

Figure 6:
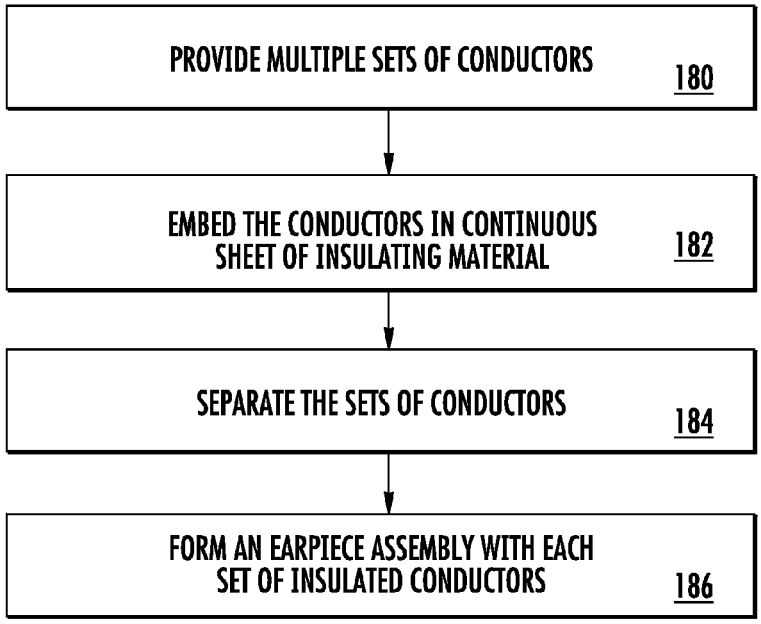
FIG. 6 is a flowchart depicting another example embodiment of a method for manufacturing a headset.

FIG. 6 is a flowchart depicting another example embodiment of a method for manufacturing a headset. As shown in FIG. 6, the method includes providing multiple sets of conductors (block 180). In block 182, the conductors are embedded in a continuous sheet of insulating material. In some embodiments, this is performed by an extrusion process. Then, as depicted in block 184, the sets of conductors are separated, and each set is used to form an earpiece assembly (block 186).

Figure 7:
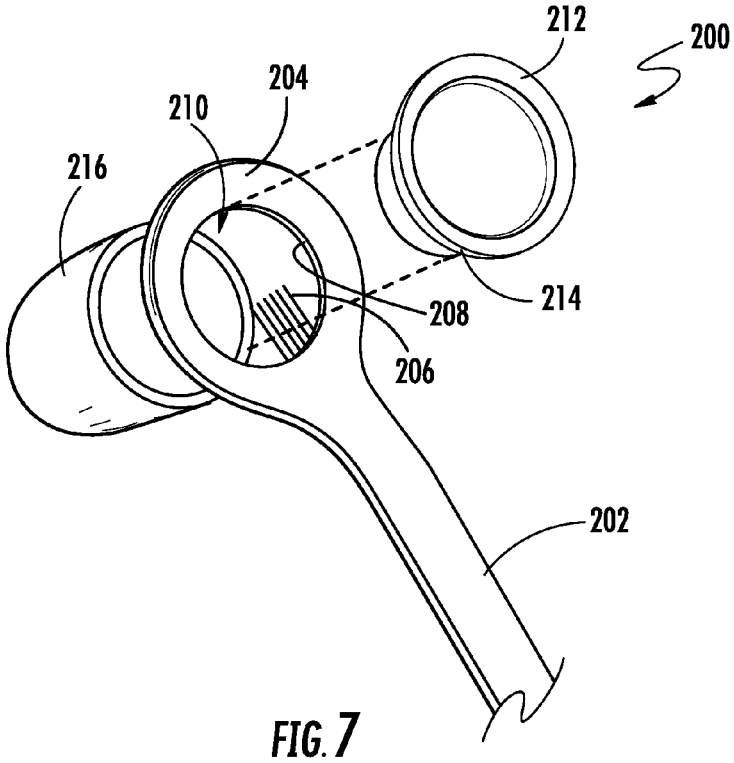
FIG. 7 is a partially-exploded, schematic diagram depicting an example embodiment of an earpiece assembly.

FIG. 7 is a partially-exploded, schematic diagram depicting an example embodiment of an earpiece assembly, such as formed by the method of FIG. 6. As shown in FIG. 7, earpiece assembly 200 includes a ribbon cable portion 202 and an earpiece portion 204. The ribbon cable portion incorporates a body of insulating material and multiple elongated conductors (e.g., conductor 206) embedded within the body.

Earpiece portion 204 extends from a distal end of the body and is configured as a contiguous extension of the insulating material of the body. As such, a seamless transition from the ribbon cable portion to the earpiece portion is provided.

The earpiece portion includes an aperture 208 that defines an opening 210. A grommet 212, which includes a flange 214, extends through the opening. The flange engages the earpiece portion and attaches the earpiece portion to earpiece 216, which fastens to the grommet. Note that various components of the earpiece have been omitted for ease of description.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

At least the following is claimed:

1. A headset comprising:

an earpiece assembly having a ribbon cable portion and an earpiece portion;

the ribbon cable portion having a body and multiple elongated conductors, the body being formed of electrically insulating material;

the earpiece portion extending from a distal end of the body, the earpiece portion defines an aperture and is configured as a contiguous extension of the insulating material of the body such that the earpiece assembly exhibits a seamless transition from the ribbon cable portion to the earpiece portion; and wherein: the headset further comprises a grommet and an earpiece, the grommet having a flange; and the grommet extends into the aperture such that the earpiece portion is captured between the flange and the earpiece, with the conductors being pressed into electrical connection with the earpiece by the grommet.

2. The headset of claim 1, wherein distal ends of the conductors extend outwardly from the insulating material of the body and into the aperture.

3. The headset of claim 1, wherein the conductors are oriented in a side-by-side arrangement across a width of the body.

4. The headset of claim 1, wherein:

the earpiece assembly is a first earpiece assembly; and the headset further comprises a second earpiece assembly having a second ribbon cable portion and a second earpiece portion.

* * * * *